United States Patent [19]

Evans

[11] 3,946,800

[45] Mar. 30, 1976

[54] PREHEATER AND METHOD OF CONTROLLING WRAP OF A WEB

[75] Inventor: Donald J. Evans, Cherry Hill, N.J.

[73] Assignee: Molins Machine Company, Inc., Camden, N.J.

[22] Filed: Sept. 26, 1974

[21] Appl. No.: 509,627

Related U.S. Application Data

[63] Continuation-in-part of Ser. No. 373,720, June 26, 1973, abandoned.

[52] U.S. Cl. ..... 165/1; 34/41; 34/52; 165/89; 432/45

[51] Int. Cl.[2] ..... F28D 11/02

[58] Field of Search ..... 432/45; 34/154, 121, 122, 34/41, 52; 165/1, 120, 89, 96

[56] References Cited

UNITED STATES PATENTS

| | | | |
|---|---|---|---|
| 1,926,292 | 9/1933 | Kruse | 34/52 |
| 2,642,676 | 6/1953 | Grimm | 34/122 |
| 2,862,304 | 12/1958 | Estienne | 34/52 |
| 2,941,573 | 6/1960 | Cassady | 34/41 |
| 3,004,880 | 10/1961 | Lord | 34/154 |
| 3,568,330 | 3/1971 | Bechtold | 165/89 |
| 3,694,927 | 10/1972 | Sorenson | 34/121 |
| 3,719,951 | 3/1973 | Kingsley | 165/89 |

*Primary Examiner*—Albert W. Davis, Jr.
*Assistant Examiner*—Daniel J. O'Connor
*Attorney, Agent, or Firm*—Seidel, Gonda & Goldhammer

[57] ABSTRACT

The amount of wrap between a web and a heated drum is varied as a function of web speed by adjusting the position of idler rollers in response to a reference speed signal.

10 Claims, 3 Drawing Figures

FIG. 1
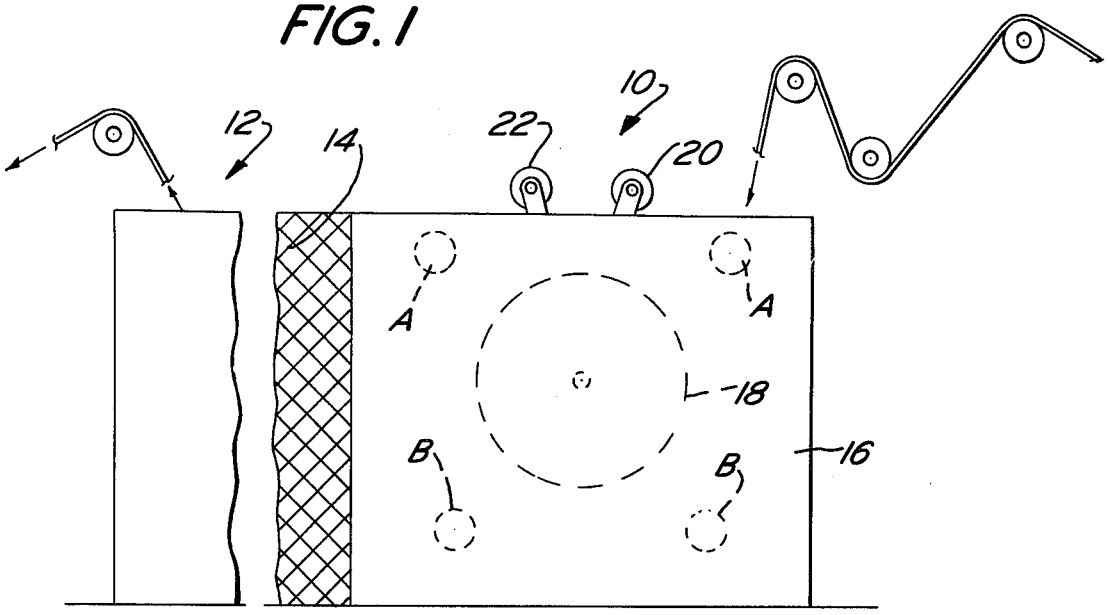
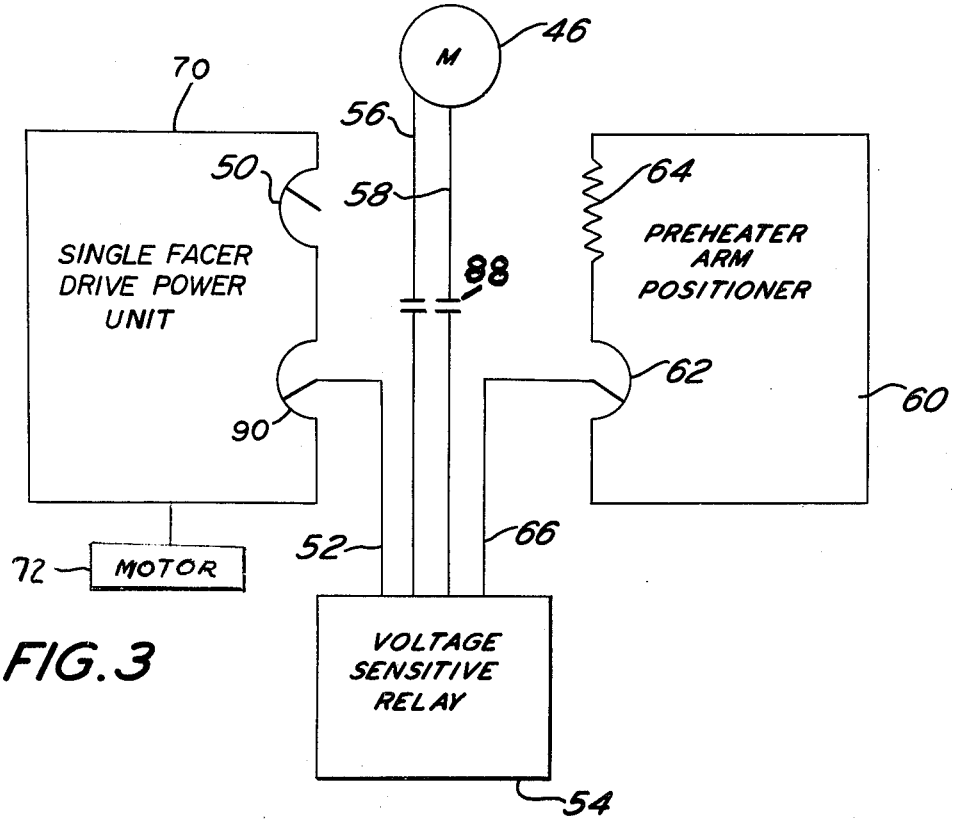
FIG. 3

PREHEATER AND METHOD OF CONTROLLING WRAP OF A WEB

COPENDING APPLICATION

This is a continuation-in-part of U.S. patent application Ser. No. 373,720, filed June 26, 1973, now abandoned.

BACKGROUND

In a corrugator for making corrugated paperboard, there is provided a double facer machine and at least one single facer machine. Each of said machines processes two webs. At least one web processed by each machine is preheated by peripheral contact with a heated drum. The heated drum and its associated elements constitutes a preheater.

A preheater for heating a web moving in a paperboard corrugator includes a frame supporting a drum. The drum is supported for rotation about the longitudinal axis thereof and is constructed to transmit heat to a web in surface contact therewith. First and second idler rollers are supported by the frame for movement about the periphery of said drum for effecting the wrap of the web over the surface of said drum. A drive means is provided including a motor responsive to changes in the speed of the web in the corrugator for causing said first and second idler rollers to move between a minimum wrap position and a maximum wrap position as the speed of the web varies from a minimum to a maximum.

At a control panel, an operator may select a speed which is indicative of the lowermost position for the idler rollers. In the lowermost position of the idler rollers, maximum heat is transferred to the web. The position of the idler rollers is moved automatically relative to the drum axis in proportion to changes in web speed to maintain a uniform transfer of heat to the web.

A voltage sensitive relay is coupled across first and second potentiometers. One such potentiometer is part of the speed setting means of the drive power unit for the single facer machine or the double facer machine. The other potentiometer is coupled to a motor to effect up and down movement of the idler rollers. If the speed of the single facer machine decreases, the voltage-sensitive relay will detect it and cause the idler rollers to move upward so as to decrease the wrap of the web on the drum and thus decrease the amount of heat transferred to the web and vice versa. Thus, the position of the idler rollers is automatically responsive to a reference speed signal indicative of the speed of the single facer machine or double facer machine which in turn corresponds to web speed.

It is an object of the present invention to provide a novel preheater.

It is another object of the present invention to provide a preheater wherein the amount of wrap is varied as a function of web speed.

It is another object of the present invention to provide a preheater which may be used in conjunction with a single facer machine or double facer machine to control the amount of wrap as a function of web speed.

It is another object of the present invention to provide a preheater which is relatively simple, inexpensive, and reliable for use in an automated corrugator for producing corrugated paperboard.

Other objects will appear hereinafter.

For the purpose of illustrating the invention, there is shown in the drawing a form which is presently preferred; it being understood, however, that this invention is not limited to the precise arrangements and instrumentalities shown.

FIG. 1 is a side elevation view of a preheater in accordance with the present invention.

FIG. 3 is a schematic circuit diagram of the drive means for the preheater.

Figure 2:
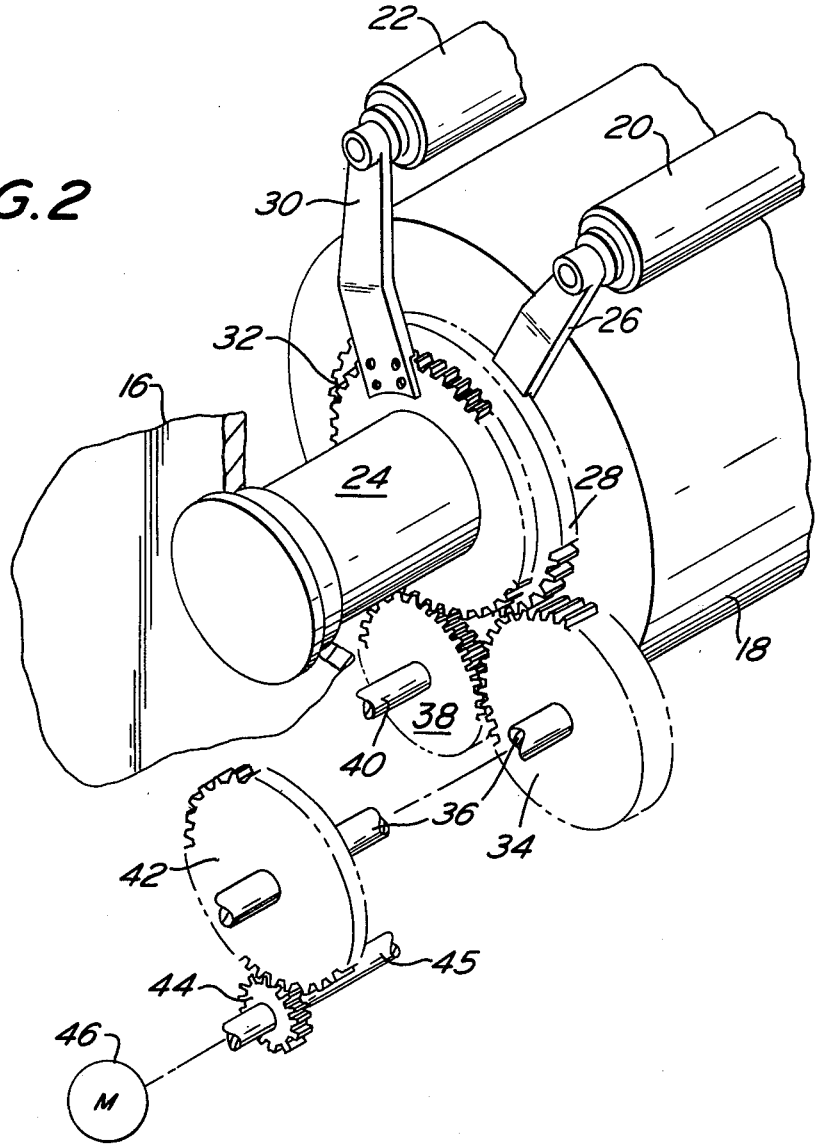
FIG. 2 is a partial perspective view of components of the preheater.

Referring to the drawing in detail, wherein like numerals indicate like elements, there is shown in FIG. 1 a preheater which may be used in conjunction with a single facer or double facer machine. For the purpose of a preferred embodiment, the preheater is associated with a single facer machine. The preheater as shown in FIG. 1 includes two preheaters 10 and 12 in tandem with a guard 14 therebetween. Since the preheaters are identical, only preheater 10 will be described in detail.

The preheater 10 includes end frames 16 which rotatably support a drum 18 for rotation about its longitudinal axis. The shaft 24 which supports the drum 18 may be hollow so that steam or some other fluid such as heated oil may be introduced into the drum 18 to heat the same. Other means for heating the drum such as electrical resistors may be utilized.

Associated with the drum 18, there are provided idler rollers 20 and 22 pivotable about the periphery thereof. The idler rollers 20 and 22 have a thread-up position as shown in FIG. 1. Each of the idler rollers may be moved to position A which designates the minimum wrap position. Also, the idler rollers may have anyone of a variety of intermediate positions down to position B which is the maximum wrap position. As web speed decreases, the amount of wrap decreases and vice versa.

Idler roller 20 is supported by arms 26 at opposite ends of the drum 18. Each arm 26 is fixedly secured to a gear segment 28 rotatably supported by shaft 24. The idler roller 22 is supported by arms 30 at opposite ends of the drum 18. Each arm 30 is fixedly secured to a gear segment 32. Gear segment 28 is slightly larger in diameter than the gear segment 32. See FIG. 2. A single idler roller may also be provided in which instance a smaller sector of the drum would be utilized. A gear 34 is provided on shaft 36. Shaft 36 is parallel to shaft 24. Gear 34 is sufficiently wide so as to be in meshing engagement with gear 38 and a portion of the periphery of gear segment 28.

Gear 38 is mounted on shaft 40 and meshes with gear segment 32. Shaft 40 is parallel to shaft 36. The gears 34 and 38 are of the same size and have the same number of teeth. A gear 42 is fixedly secured to shaft 36 and is in meshing engagement with a smaller gear 44 on shaft 45. Shaft 45 is a drive shaft parallel to shaft 36. A reversible motor 46 is connected to shaft 45.

Rotation of motor 46 causes rotation of shaft 45 and small gear 44 which is meshed with gear 42. The gear 34 on shaft 36 rotates the gear segment 28 which in turn causes the arm 26 to pivot whereby the idler roller 20 may assume various positions between the thread-up position shown in FIG. 1 and the maximum wrap position B. Likewise, gear 38 causes gear segment 32 to rotate causing arm 30 to pivot and move the idler roller from the thread-up position in FIG. 1 to any one of a plurality of intermediate positions down to the maximum wrap position B.

Referring to FIG. 3, the single facer drive power unit 70 which controls single facer drive motor 72 includes manually adjustable potentiometer 50. The unit 70 also includes a motor operated potentiometer 90. The motor operated potentiometer 90 is connected to voltage sensitive relay 54 by way of conductor 52. The voltage sensitive relay include normally open contacts 88. The contacts 88 of the relay 54 are connected by way of conductors 56 and 58 to reversible motor 46.

A preheater arm positioner 60 includes a resistor 64 in series with motor operated potentiometer 62. The motor operated potentiometer 62 is connected to the voltage sensitive relay 54 by way of conductor 66 and is mechanically driven in any convenient manner, such as by a coupling with shaft 36, as a function of the position of arms 26 and 30.

The direction of rotation of motor 46 will be dictated by the relationship of the signals communicated to the voltage sensitive relay 54 from potentiometer 90 and 62 by way of the conductors 52 and 66 respectively. Potentiometer 50 provides a manually adjustable bias or control for balancing out the resistor 64.

The single facer drive power unit 70 sets the speed of the single facer machine and the motor operated potentiometer 90 generates a speed reference signal which is used to control reversible motor 46. Any difference in the potential of signals communicated to relay 54 by conductors 52 and 66 causes voltage sensitive relay 54 to close one of the contacts 88 and activate reversible motor 46. Reversible motor 46 causes idler rollers 20 and 22 to move between positions A and B or vice versa. As rollers 20, 22 move, potentiometer 62 is also simultaneously driven inducing a signal in conductor 66.

When the operator wishes to introduce a new web over the preheaters 10, 12 the "manual/automatic" switch is turned to "manual". Engaging the "raise" pushbutton causes the arms 26, 30 to rise to the point of zero wrap shown in FIG. 1 at A and to continue to the highest point. When the arms reach the highest point as shown in FIG. 1, a limit switch is engaged to turn on a green light. This is the "go" signal for the operator to thread the web. After threading the web, the operator pushes a "lower" pushbutton to lower the arms. As the arms 26, 30 lower the green light goes off. The arms 26, 30 continue to the zero wrap point. A limit switch at this point allows the machine to be put in the automatic mode. When the "manual/automatic" switch is turned to "automatic" a red light is turned on.

The present invention may be embodied in other specific forms without departing from the spirit or essential attributes thereof and, accordingly, reference should be made to the appended claims, rather than to the foregoing specification as indicating the scope of the invention.

I claim:

1. A preheater for heating a web moving in a paperboard corrugator comprising a frame, a drum supported by said frame for rotation about the longitudinal axis thereof, said drum being constructed to transmit heat to a web in surface contact therewith, first and second idler rollers supported for movement about the periphery of said drum for effecting the wrap of a web over the surface of said drum, drive means including a motor responsive to changes in the speed of the web in the corrugator for causing said first and second idler rollers to move between a minimum wrap position and a maximum wrap position as the speed of the web varies from a minimum to a maximum.

2. A preheater in accordance with claim 1 wherein each idler roller is supported by at least one arm extending from a gear segment, each gear segment being mounted for rotation so that the maximum wrap position is below the elevation of the longitudinal axis of said drum, whereby said idler rollers pivot as they move between their minimum and maximum wrap positions.

3. A preheater in accordance with claim 1 wherein the reversible motor included in said drive means is coupled to a potentiometer and an arm positioner.

4. A preheater in accordance with claim 3 wherein said potentiometer is connected to a voltage sensitive relay, a second potentiometer responsive to the speed of the web is also connected to said voltage sensitive relay whereby said reversible motor operates in response to a difference in potential between said potentiometers as detected by said relay.

5. A preheater for a combining unit in a corrugator for heating a web comprising a frame, a drum supported on its longitudinal axis by said frame, said drum being constructed to heat a web in surface contact therewith, means supported for movement about the periphery of said drum for effecting the wrap of a web over the surface of said drum, means including a motor for driving said combining unit, means associated with said driving motor for generating a signal indicative of the speed thereof, means including a reversible motor for causing said wrap effecting means to pivot about the periphery of said drum, means associated with said reversible motor for generating a signal indicative of the position of said wrap effecting means on the periphery of said drum, and means for comparing said position signal with said drive motor speed signal and generating an output signal whereby said reversible motor is operated to vary the wrap of the web on said drum as a function of the said drive motor speed.

6. A preheater in accordance with claim 5 wherein said comparing means includes a voltage sensitive relay for detecting a difference between the signal indicative of the speed of said driving motor and the signal indicative of the position of said wrap effecting means.

7. A method of controlling the transfer of heat between a web and a heated drum of a preheater forming part of a corrugator by varying the wrap of the web on the drum comprising generating a reference signal indicative of the speed of the web, generating a second signal indicative of the position of an idler roller associated with said drum so long as its position is within a range defined by minimum and maximum wrap positions, comparing said signals, and moving the idler roller within said range in response to a difference in the signals so that the amount of wrap varies as the speed of web varies with maximum wrap occurring at maximum web speed.

8. A method in accordance with claim 5 wherein said signals are generated using potentiometers.

9. A method in accordance with claim 7 wherein said comparing step includes comparing voltages, and said step of moving the idler roller includes driving a reversible motor coupled to the idler roller.

10. A method in accordance with claim 7 including generating said reference signal at the drive power unit of a machine which acts on the web downstream from said preheater.

* * * * *